US011186796B2

(12) United States Patent
Liang et al.

(10) Patent No.: US 11,186,796 B2
(45) Date of Patent: Nov. 30, 2021

(54) LIQUID ANTI-FRICTION COMPOSITION

(71) Applicant: PATECH FINE CHEMICALS CO., LTD., Taipei (TW)

(72) Inventors: Wei-Chieh Liang, Xianxi Township, Changhua County (TW); Jung-Tsung Hung, Xianxi Township, Changhua County (TW); Hsu-Hua Tang, Xianxi Township, Changhua County (TW); Jun-Wei Wu, Xianxi Township, Changhua County (TW); Jeng-Shiang Tsaih, Xianxi Township, Changhua County (TW)

(73) Assignee: PATECH FINE CHEMICALS CO., LTD., Taipei (TW)

( * ) Notice: Subject to any disclaimer, the term of this patent is extended or adjusted under 35 U.S.C. 154(b) by 0 days.

(21) Appl. No.: 16/922,413

(22) Filed: Jul. 7, 2020

(65) Prior Publication Data

US 2021/0009915 A1 Jan. 14, 2021

(30) Foreign Application Priority Data

Jul. 10, 2019 (TW) ..... 108124303

(51) Int. Cl.

| | |
|---|---|
| ***C10M 105/44*** | (2006.01) |
| *C10N 30/02* | (2006.01) |
| *C10N 40/25* | (2006.01) |

(52) U.S. Cl.

CPC .. *C10M 105/44* (2013.01); *C10M 2207/3025* (2013.01); *C10N 2030/02* (2013.01); *C10N 2040/25* (2013.01)

(58) Field of Classification Search

CPC ..... C10M 2203/1025; C10M 105/44; C10M 129/80; C10M 2207/289; C10M 2207/30; C10M 2207/3025; C10N 2020/02; C10N 2030/02; C10N 2030/06; C10N 2030/10; C10N 2030/54; C10N 2030/70; C10N 2040/25; C07C 67/03; C07C 69/02; C07C 69/34; C07C 69/52

See application file for complete search history.

(56) References Cited

FOREIGN PATENT DOCUMENTS

| | | | |
|---|---|---|---|
| CN | 103380163 A | | 10/2013 |
| JP | 56 040605 | * | 4/1981 |
| JP | 10-265324 | * | 10/1998 |
| WO | 2017/016825 A1 | | 2/2017 |

OTHER PUBLICATIONS

JP10-265324 machine translation (Year: 1998).*
JP10-265324 human partial translation, 1 page (Year: 1998).*
Astm D445 19a (Year: 2016).*
JP56 040605 translated (19 pages) (Year: 1981).*
Search Report appended to an Office Action, which was issued to Taiwanese counterpart application No. 108124303 by the TIPO dated Apr. 15, 2020, with an English translation thereof.

* cited by examiner

*Primary Examiner* — Yevgeny Valenrod
*Assistant Examiner* — Blaine G Doletski
(74) *Attorney, Agent, or Firm* — Hamre, Schumann, Mueller & Larson, P.C.

(57) ABSTRACT

A liquid anti-friction composition includes an ester product having a number average molecular weight that is greater than 3800 g/mol, and obtained by subjecting a mixture that includes diglycerol, a monobasic acid component, and a dibasic acid component to an esterification reaction. The monobasic acid component includes at least one $C_{14}$-$C_{24}$ branched chain fatty acid.

18 Claims, No Drawings

LIQUID ANTI-FRICTION COMPOSITION

CROSS-REFERENCE TO RELATED APPLICATION

This application claims priority of Taiwanese Patent Application No. 108124303, filed on Jul. 10, 2019.

FIELD

The present disclosure relates to an anti-friction composition, and more particularly to a liquid anti-friction composition including an ester product.

BACKGROUND

PCT International Patent Publication No. WO 2017/016825 A1 discloses a lubricating oil composition including a polyglycerolpartialester that is obtained by subjecting a polyglycerol mixture, polyfunctional carboxylic acid, fatty acids, and poly(hydroxystearic acid) to an esterification reaction. The polyglycerol partial ester has a hydroxyl value that ranges from 50 mg KOH/g to 180 mg KOH/g. The polyglycerol mixture has an esterification degree that ranges between 30% and 75% of hydroxyl (—OH) group, and an average condensation degree that ranges from 3 to 6. The polyfunctional carboxylic acid is an aliphatic dicarboxylic acid. The fatty acids are saturated or unsaturated, linear or branched fatty acids having 8 to 22 carbon atoms.

The lubricating oil composition disclosed in the aforesaid PCT patent application is capable of lubricating an engine, and reducing friction and energy loss in the engine, thereby achieving energy saving effect. However, there is still a need to develop an anti-friction composition with improved friction reducing performance so as to satisfy the requirements of various industries.

SUMMARY

Therefore, an object of the present disclosure is to provide a liquid anti-friction composition, which can alleviate at least one of the drawbacks of the prior art.

The liquid anti-friction composition includes an ester product having a number average molecular weight that is greater than 3800 g/mol. The ester product is obtained by subjecting a mixture that includes diglycerol, a monobasic acid component, and a dibasic acid component to an esterification reaction. The monobasic acid component includes at least one $C_{14}$-$C_{24}$ branched chain fatty acid.

DETAILED DESCRIPTION

For the purpose of this specification, it will be clearly understood that the word "comprising" means "including but not limited to", and that the word "comprises" has a corresponding meaning.

Unless otherwise defined, all technical and scientific terms used herein have the meaning commonly understood by a person skilled in the art to which this disclosure belongs. One skilled in the art will recognize many methods and materials similar or equivalent to those described herein, which could be used in the practice of this disclosure. Indeed, this disclosure is in no way limited to the methods and materials described.

The present disclosure provides a liquid anti-friction composition including an ester product, which is obtained by subjecting a mixture that includes diglycerol, a monobasic acid component, and a dibasic acid component to an esterification reaction. The monobasic acid component includes at least one $C_{14}$-$C_{24}$ branched chain fatty acid. The ester product has a number average molecular weight that is greater than 3800 g/mol.

In certain embodiments, the number average molecular weight of the ester product ranges from 4200 g/mol to 6000 g/mol, such that the liquid anti-friction composition may have a more improved anti-friction effect (i.e., more reduced friction or more enhanced lubricity).

In certain embodiments, the ester product has an esterification degree of greater than 80%, such that the liquid anti-friction composition may have a more enhanced anti-friction effect.

The diglycerol is a commercial product available from manufacturers such as Solvay S.A., Spiga Nord S.p.A., Lonza Group AG, Sakamoto Orient Chemicals Corporation, etc.

In certain embodiments, the monobasic acid component further includes at least one straight chain $C_{14}$-$C_{24}$ fatty acid. The $C_{14}$-$C_{24}$ branched and/or straight chain fatty acid may be a $C_{14}$-$C_{24}$ saturated fatty acid or a $C_{14}$-$C_{24}$ unsaturated fatty acid. Exemplary $C_{14}$-$C_{24}$ saturated fatty acids suitable for use in this disclosure may include, but are not limited to, myristic acid, palmitic acid, stearic acid, arachidic acid, behenic acid, and combinations thereof.

Exemplary $C_{14}$-$C_{24}$ unsaturated fatty acids suitable for use in this disclosure may include, but are not limited to, oleic acid, palmitoleic acid, linoleic acid, linolenic acid, erucic acid, and combinations thereof.

In certain embodiments, the monobasic acid component includes at least one $C_{18}$ fatty acid. The at least one $C_{18}$ fatty acid is present in an amount that is greater than 70 wt % based on 100 wt % of the monobasic acid component, such that the liquid anti-friction composition may have more improved compatibility with a base oil of an engine.

In other embodiments, the monobasic acid component includes at least one $C_{16}$ fatty acid and at least one $C_{18}$ fatty acid. For example, the monobasic acid component may include several different $C_{16}$ fatty acids and several different $C_{18}$ fatty acids.

In order to obtain the ester product having the number average molecular weight that is greater than 3800 g/mol and to avoid the formation of a gel-like or non-liquid cross-linked ester product, in certain embodiments, the monobasic acid component is present in an amount that ranges from 60 wt % to 85 wt % based on 100 wt % of the mixture.

In certain embodiments, the dibasic acid component includes at least one $C_6$-$C_{10}$ dibasic acid. Examples of the $C_6$-$C_{10}$ dibasic acid may include, but are not limited to, adipic acid, pimelic acid, suberic acid, azelaic acid, and sebacic acid.

In order to obtain the ester product having the number average molecular weight that is greater than 3800 g/mol and to avoid the formation of a gel-like or non-liquid cross-linked ester product, in certain embodiments, the dibasic acid component is present in an amount that ranges from 10 wt % to 20 wt % based on 100 wt % of the mixture.

In certain embodiments, the esterification reaction is conducted at a temperature that ranges from 160° C. to 240° C.

In certain embodiments, the liquid anti-friction composition has a kinematic viscosity at 100° C. that is greater than 500 cSt, as determined according to ASTM D445.

In addition, the esterification reaction may be further conducted in the presence of a catalyst. Examples of the catalyst suitable for use in this disclosure may include, but are not limited to, stannous oxalate ($SnC_2O_4$), stannous oxide (SnO), tetrabutyl titanate, titanium tetraisopropanolate, methanesulfonic acid, and combinations thereof.

The present disclosure also provides a method for lubricating an engine that includes a turbocharger and/or reducing friction in the engine, including applying the abovementioned liquid anti-friction composition to the engine.

The present disclosure will be further described by way of the following examples. However, it should be understood that the following examples are intended solely for the purpose of illustration and should not be construed as limiting the present disclosure in practice.

EXAMPLES

Preparation of Anti-Friction Compositions

Example 1 (E1)

A mixture, including diglycerol (Manufacturer: Sakamoto Orient Chemicals Corporation), adipic acid (serving as a dibasic acid component), and a monobasic acid component in a specified amount and wt % as shown in Table 1 below, was subjected to an esterification reaction at a temperature of 220±5° C., so as to obtain an ester product in a liquid form serving as an anti-friction composition of E1. The monobasic acid component used in the mixture includes several different $C_{16}$ fatty acids and several different $C_{18}$ fatty acids, and the $C_{18}$ fatty acids are present in an amount of 80±5 wt % based on 100 wt % of the monobasic acid component. At least one of the abovementioned fatty acids is a branched chain fatty acid.

Comparative Examples 1 and 6 to 8 (CE1 and CE6 to CE8)

The procedures for preparing a respective one of the anti-friction compositions of CE1 and CE6 to CE8 were similar to those of E1, except for differences in the amount and wt % of the diglycerol, adipic acid, and monobasic acid component applied in CE1 and CE6 to CE8, which are shown in Table 1 below.

Comparative Examples 2 to 4 (CE2 to CE4)

The procedures for preparing a respective one of the anti-friction compositions of CE2 to CE4 were similar to those of E1, except that diglycerol was replaced with tetraglycerol in CE2, and was replaced with pentaerythritol in CE3 and CE4. The amount and wt % of the tetraglycerol, pentaerythritol, adipic acid, and monobasic acid component used in CE2 to CE4 are shown in Table 1 below.

Comparative Example 5 (CE5)

A commercially available anti-friction agent (Manufacturer: Croda International PLC; Model No.: Perfad™ 3057) was directly utilized as CE5.

Property Evaluation for Liquid and Non-Liquid Anti-Friction Compositions Prepared 1. Kinematic Viscosity and Viscosity Index The kinematic viscosity for each of the anti-friction compositions of E1 and CE1 to CE5 was measured according to the procedures set forth in ASTM D445 at 100° C. using a viscometer (Manufacturer: Anton Paar Co. Ltd.; Model No.: SVM 3000), and the viscosity index thereof was calculated based on the measured kinematic viscosity.

2. Number Average Molecular Weight 1 g of the anti-friction composition of the respective one of E1, CE1 to CE4, and CE6 to CE6 was dissolved in tetrahydrofuran, and then was subjected to a liquid chromatography analysis (column type: ACQUITY APC™ from Waters Corporation; mobile phase: tetrahydrofuran; flow rate: 0.5 mL/min; temperature: 40° C.) with polystyrene as a standard, so as to determine the number average molecular weight of the ester product in the anti-friction composition.

3. Esterification Degree

The esterification degree of the ester product of the anti-friction composition of the respective one of E1, CE1 to CE4, and CE6 to CE6 was calculated using the following formula:

$$A=[(B-C)/B]\times 100\%$$

where A=esterification degree

B=hydroxyl value of diglycerol

C=hydroxyl value of the ester product of the respective anti-friction composition The hydroxyl value (unit: mg KOH/g) was determined through acetic anhydride acetylation according to the procedures set forth in ASTM E222.

4. Compatibility with Base Oil

In order to determine the compatibility with a base oil, 1 g of the anti-friction composition of the respective one of E1, CE1 to CE4, and CE7 was blended with 99 g of a base oil (Manufacturer: SK Lubricants; Model No.: Yubase 4) at 80° C., and the resultant blend was then left to stand at room temperature for 24 hours, so as to visually observe whether there was presence of stratification, precipitation or fogging in the resultant blend.

5. Anti-Friction Test 1 wt % of the anti-friction composition of the respective one of E1 and CE2 to CE4 was mixed with 99 wt % of a base oil (Manufacturer: SK Lubricants; Model No.: Yubase 4), so as to obtain test samples of E1 and CE2 to CE4. An anti-friction property (i.e., wear preventive characteristics) was evaluated by measuring a scar diameter of the respective test sample using a four-ball wear test machine according to the procedures set forth in ASTM D4172-94(2016), which was conducted under a temperature of 75° C., a rotation speed of 1200 rpm, and a load of 40±0.2 kg for 1 hour.

6. Oxidative Stability Test

The oxidative stability was evaluated by measuring an oxidation onset temperature of the anti-friction composition of the respective one of E1, CE3 and CE5 using a differential scanning calorimeter analyzer (Manufacturer: TA Instruments; Model No.: Q20) according to the procedures set forth in ASTM E2009-08(2014), which was conducted under an atmosphere of oxygen that had a pressure of 500 psi and a flow rate of 50 mL/min, and a temperature that increased from room temperature up to 250° C. with a heating rate of 5° C./min.

TABLE 1

| Anti-friction composition | | E1 | CE1 | CE2 | CE3 | CE4 | CE5 | CE6 | CE7 | CE8 |
|---|---|---|---|---|---|---|---|---|---|---|
| Reaction mixture (wt %) | Diglycerol | 218 g (20.2) | 225 g (21) | 0 | 0 | 0 | — | 275 g (25.1) | 190 g (17.8) | 235 g (21.7) |
| | Tetraglycerol | 0 | 0 | 272 g (25.5) | 0 | 0 | — | 0 | 0 | 0 |
| | Pentaerythritol | 0 | 0 | 0 | 209 g (19.2) | 229 g (21.2) | — | 0 | 0 | 0 |
| | Dibasic acid component: Adipic acid | 167 g (15.4) | 116 (10.9) | 110 g (10.3) | 187 g (17.2) | 164 g (15.2) | — | 220 g (20.1) | 85 g (8.0) | 200 g (18.4) |
| | Monobasic acid component | 696 g (64.4) | 728 g (68.1) | 684 g (64.2) | 691 g (63.6) | 688 g (63.6) | — | 600 g (54.8) | 790 g (74.2) | 650 g (59.9) |
| Property evaluation | Kinematic viscosity at 100° C. (cSt) | 550 | 130 | 150 | 880 | 160 | 221 | n.d. | n.d. | n.d. |
| | Viscosity index | 230 | 166 | 151 | 234 | 125 | 146 | n.d. | n.d. | n.d. |
| | Number average molecular weight | 4200 | 1500 | 5500 | 3800 | 2000 | n.d. | 4500 | 1500 | 8400 |
| | Esterification degree (%) | 85 | 72 | 74 | 78 | 69 | n.d. | 74 | 80 | 85 |
| | State of matter | Liquid | Liquid | Liquid | Liquid | Liquid | Liquid | Gel-like | Liquid | Gel-like |
| | Base oil compatibility | Yes | Yes | Yes | Yes | Yes | n.d. | n.d. | Yes | n.d. |
| | Scar diameter (mm) | 0.528 | n.d. | 0.578 | 0.600 | 0.605 | 0.623 | n.d. | n.d. | n.d. |
| | Oxidation onset temperature (° C.) | 172 | n.d. | n.d. | 171 | n.d. | 155 | n.d. | n.d. | n.d. |

"—": not applicable;

"n.d.": not determined

As shown in Table 1, although the number average molecular weights of both the ester products of the anti-friction compositions of E1 and CE2 are greater than 3800 g/mol, the ester product of E1, which was formed by a reaction mixture including diglycerol, has a smaller scar diameter as compared to that of the ester product of CE2 which was formed by a reaction mixture including tetraglycerol. Although the ester products of CE6 and CE8 also have the number average molecular weight greater than 3800 g/mol and were obtained from a reaction mixture including diglycerol, the resultant anti-friction compositions are not in a liquid form. In addition, the ester products of the anti-friction compositions of CE3 and CE4, each of which was formed by a reaction mixture that includes pentaerythritol, have a number average molecular weight that is smaller than 3800 g/mol and a greater scar diameter as compared to those of the ester product of the anti-friction composition of E1. As compared to the commercially available anti-friction agent of CE5, the anti-friction composition of E1 has a smaller scar diameter and exhibits improved oxidative stability.

These results indicate that the ester product of the anti-friction composition of this disclosure, which is in a liquid form, and which is obtained from a reaction mixture including diglycerol and has the number average molecular weight of greater than 3800 g/mol, exhibits an excellent anti-friction effect.

Application Examples 1 and 2 (AE1 and AE2) and Comparative Application Examples 1 to 4 (CAE1 to CAE4)

1 wt % of the anti-friction composition of the respective one of E1, CE1, CE2, and CE5 was blended with 99 wt % of an engine oil SAE 0W16, so as to obtain test samples of AE1 and CAE1 to CAE3. In addition, 1 wt % of the anti-friction composition of the respective one of E1 and CE5 was blended with 99 wt % of an engine oil SAE 0W40, so as to obtain test samples of AE2 and CAE4.

Comparative Application Examples 5 and 6 (CAE5 and CAE6)

100 wt % of the engine oil 0W16 and 100 wt % of the engine oil 0W40 were used as test samples of CAE5 and CAE6, respectively.

Property Evaluation for AE1, AE2, and CAE1 to CAE6

Each of the test samples of AE1, CAE1 to CAE3, and CAE5 was subjected to a wear test using a block-on-ring test machine (Manufacturer: Reichert, Inc.), which was conducted under a temperature of 120° C., a load of 200.2 kg, and a rotation speed ranging from 0 rpm to 400 rpm with an increasing rate of 200 rpm/min, so as to measure the friction coefficient and thereby obtain a Stribeck curve for each test sample. After that, the Stribeck curves of the test samples of AE1, CAE1 to CAE3, and CAE5 were integrated to obtain corresponding energy consumption values. The improvement in energy use efficiency for each of the test samples of AE1 and CAE1 to CAE3 relative to CAE5 was calculated using the following formula:

$$A=[(B-C)/B]\times 100\%$$

where A=improvement in energy use efficiency

B=energy consumption value of CAE5

C=energy consumption value of AE1, CAE1, CAE2 or CAE3

On the other hand, the test samples of AE2, CAE4 and CAE6 were also subjected to a wear test similar to the above wear test, except that a rotation speed of 400 rpm was applied for a time period of 1 hour, and a friction area ($mm^2$) was determined.

TABLE 2

| | | AE1 | AE2 | CAE1 | CAE2 | CAE3 | CAE4 | CAE5 | CAE6 |
|---|---|---|---|---|---|---|---|---|---|
| Engine oil | 0W16 (wt %) | 99 | 0 | 99 | 99 | 99 | 0 | 100 | 0 |
| | 0W40 (wt %) | 0 | 99 | 0 | 0 | 0 | 99 | 0 | 100 |
| Anti-friction composition | Examples | E1 | E1 | — | — | — | — | — | — |
| | Comparative Examples | — | — | CE1 | CE2 | CE5 | CE5 | — | — |
| | Amount (wt %) | 1 | 1 | 1 | 1 | 1 | 1 | — | — |
| Property evaluation | Energy consumption (J) | 95.4 | n.d. | 99.1 | 100.1 | 100.4 | n.d. | 101.3 | n.d. |
| | Improvement in energy use efficiency (%) | 5.82 | n.d. | 2.17 | 1.18 | 0.89 | n.d. | — | n.d. |
| | Wear scar area ($mm^2$) | n.d. | 0.48 | n.d. | n.d. | n.d. | 0.50 | n.d. | 0.52 |

"—": not applicable;
"n.d.": not determined

As shown in Table 2, although the anti-friction compositions of CE1, CE2, and CE5 respectively used in CAE1, CAE2 and CAE3 can reduce the energy consumption values from 101.3 J (i.e., shown by the engine oil 0W16 of CAE5) to a range from 99.1 J to 100.4 J, the energy consumption value of AE1, which contains the anti-friction composition of E1, is significantly reduced to 95.4 J. The results indicate that the anti-friction composition of this disclosure demonstrates an enhanced improvement in energy use efficiency, and thus has an excellent energy-saving effect.

In addition, as compared to the friction area determined in CAE4 (i.e., 0.50 $mm^2$) and CAE6 (i.e., 0.52 $mm^2$), the friction area determined in AE2 is significantly lower, indicating that the anti-friction composition of E1 has an improved anti-friction effect, and is capable of effectively improving the lubricity of engine oil.

In summary, by inclusion of diglycerol in the mixture subjected to the esterification reaction, and by controlling the number average molecular weight of the resultant ester product to be greater than 3800 g/mol, the liquid anti-friction composition of the present disclosure is conferred with an excellent anti-friction effect. Therefore, the liquid anti-friction composition of the present disclosure is expected to be useful for improving the lubricity of an engine oil, so as to reduce the energy consumption of an internal combustion engine, thereby achieving an energy-saving effect.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A liquid anti-friction composition, comprising an ester product having a number average molecular weight that is greater than 3800 g/mol, and obtained by subjecting a mixture that includes diglycerol, a monobasic acid component, and a dibasic acid component to an esterification reaction, said monobasic acid component including at least one $C_{14}$-$C_{24}$ branched chain fatty acid and at least one $C_{14}$-$C_{24}$ straight chain fatty acid, wherein said monobasic acid component includes at least one $C_{18}$ fatty acid present in an amount that is greater than 70 wt % based on 100 wt % of said monobasic acid component.

2. The liquid anti-friction composition as claimed in claim 1, wherein said monobasic acid component further includes at least one $C_{16}$ fatty acid.

3. The liquid anti-friction composition as claimed in claim 1, wherein said monobasic acid component is present in an amount that ranges from 60 wt % to 85 wt % based on 100 wt % of said mixture.

4. The liquid anti-friction composition as claimed in claim 1, wherein said monobasic acid component is present in an amount that ranges from 60 wt % to 85 wt % based on 100 wt % of said mixture.

5. The liquid anti-friction composition as claimed in claim 2, wherein said monobasic acid component is present in an amount that ranges from 60 wt % to 85 wt % based on 100 wt % of said mixture.

6. The liquid anti-friction composition as claimed in claim 1, wherein said dibasic acid component is present in an amount that ranges from 10 wt % to 20 wt % based on 100 wt % of said mixture.

7. The liquid anti-friction composition as claimed in claim 1, wherein said ester product has an esterification degree of greater than 80%.

8. The liquid anti-friction composition as claimed in claim 3, wherein said ester product has an esterification degree of greater than 80%.

9. The liquid anti-friction composition as claimed in claim 6, wherein said ester product has an esterification degree of greater than 80%.

10. The liquid anti-friction composition as claimed in claim 1, wherein said liquid anti-friction composition has a kinematic viscosity at 100° C. that is greater than 500 cSt, as determined according to ASTM D445.

11. A liquid anti-friction composition, comprising an ester product having a number average molecular weight that is greater than 3800 g/mol, and obtained by subjecting a mixture that includes diglycerol, a monobasic acid component, and a dibasic acid component to an esterification reaction, said monobasic acid component including at least one $C_{14}$-$C_{24}$ branched chain fatty acid and at least one $C_{14}$-$C_{24}$ straight chain fatty acid, wherein said dibasic acid component includes at least one $C_6$-$C_{10}$ dibasic acid.

12. The liquid anti-friction composition as claimed in claim 11, wherein said $C_6$-$C_{10}$ dibasic acid is selected from the group consisting of adipic acid, pimelic acid, suberic acid, azelaic acid and sebacic acid.

13. The liquid anti-friction composition as claimed in claim 11, wherein said dibasic acid component is present in an amount that ranges from 10 wt % to 20 wt % based on 100 wt % of said mixture.

14. The liquid anti-friction composition as claimed in claim 12, wherein said dibasic acid component is present in an amount that ranges from 10 wt % to 20 wt % based on 100 wt % of said mixture.

15. The liquid anti-friction composition as claimed in claim 11, wherein said ester product has an esterification degree of greater than 80%.

16. The liquid anti-friction composition as claimed in claim 12, wherein said ester product has an esterification degree of greater than 80%.

17. A method for lubricating an engine and reducing friction in the engine, comprising applying the liquid anti-friction composition as claimed in claim 1 to the engine.

18. A method for lubricating an engine and reducing friction in the engine, comprising applying the liquid anti-friction composition as claimed in claim 11 to the engine.

* * * * *